US005560514A

United States Patent [19]

Frazier

[11] Patent Number: 5,560,514

[45] **Date of Patent: * Oct. 1, 1996**

[54] WET WIPE DISPENSING NOZZLE WITH ROTATABLE PORT

[75] Inventor: Alan D. Frazier, West Chester, Pa.

[73] Assignee: Kimberly-Clark Tissue Company, Neenah, Wis.

[ * ] Notice: The portion of the term of this patent subsequent to Mar. 23, 2008, has been disclaimed.

[21] Appl. No.: 763,683

[22] Filed: Sep. 23, 1991

[51] Int. Cl.[6] ..... B65H 1/00

[52] U.S. Cl. ..... 221/63; 206/210

[58] Field of Search ..... 221/63, 64, 308, 221/307, 303, 304; 222/545, 546; 225/106; 206/210, 205, 409, 410, 494

[56] References Cited

U.S. PATENT DOCUMENTS

| | | | |
|---|---|---|---|
| 3,163,323 | 12/1964 | Behrens et al. | 221/304 |
| 3,749,296 | 7/1973 | Harrison | 225/106 |
| 3,868,052 | 2/1975 | Rockefeller | 225/106 |
| 4,017,002 | 4/1977 | Doyle et al. | 221/63 |
| 4,171,047 | 10/1979 | Doyle et al. | 206/210 |
| 4,180,160 | 12/1979 | Ogawa et al. | 206/210 |
| 4,219,129 | 8/1980 | Sedgwick | 221/63 |
| 4,328,907 | 5/1982 | Beard | 221/63 |
| 4,353,480 | 10/1982 | McFadyen | 221/63 |
| 4,462,507 | 7/1984 | Margulies | 221/63 |
| 4,526,291 | 7/1985 | Margulies | 221/63 |
| 4,651,895 | 3/1987 | Niske et al. | 221/63 |
| 4,899,905 | 2/1990 | Holtsch | 221/63 |

*Primary Examiner*—Kenneth Noland
*Attorney, Agent, or Firm*—Jeffrey B. Curtin

[57] ABSTRACT

A centerflow dispenser for dispensing saturated wipers is disclosed which includes a dispensing nozzle affixed to the container of wet wipes. The nozzle has included therewith a rotatable dispensing disk through which the rolled web is dispensed. The rotatable disk has a dispensing orifice therethrough which includes a node and a plurality of contiguous appendages such that the disk will rotate to the path of least resistance as the saturated wipers are drawn through the dispensing orifice regardless of the direction of extraction of the web through the orifice. One or more drain holes are provided through the dispensing disk to allow liquid squeezed from the wiper as it is drawn through the dispensing orifice to pass back into the container. The nozzle includes a funneled or frusto-conical section which collects any liquid squeezed or which may drip from the wiper as it is extracted from the container to thereby direct such liquid toward the drain holes in dispensing disk. A cap is provided which sealingly engages the nozzle to limit vapor emissions from the container when the cap is in the closed position.

24 Claims, 2 Drawing Sheets

WET WIPE DISPENSING NOZZLE WITH ROTATABLE PORT

BACKGROUND OF THE INVENTION

1. Field of the Invention

The present invention relates generally to wet wipe containers and, more particularly, to dispensing nozzles through which wet wipes are dispensed from the container.

2. Brief Description of the Prior Art

A variety of wet wipe container/dispensers are known in the prior art. One such container/dispenser is taught in U.S. Pat. No. 4,180,160 to Ogawa, et al. The Ogawa, et al. patent discloses a wet tissue drawing member affixed to the top of the container. The wet tissue drawing member may be in the form of a soft rubber disk (see FIG. 8 thereof) with a hole therethrough. Projecting up from the top of the container is a cylindrical neck which is engagable with a protective cap. The protective cap is restrained by a flexible strip extending therefrom attached to the top of the container.

U.S. Pat. No. 4,171,047 to Doyle, et al. discloses a wet wipe container which includes an exit slit or opening at the base of what appears to be a funneled exit nozzle. A cap for the funneled exit nozzle appears to be integrally formed with the top of the container and an interconnecting restraining strap.

U.S. Pat. No. 4,219,129 to Sedgwick teaches yet another moist tissue dispenser very similar to that which is taught by Doyle, et al. A funneled exit port integrally formed with the top of the container having a dispensing opening therethrough. A cap is provided to seal the funneled exit port, the cap having a restraining strap extending therefrom attached to the top of the container.

U.S. Pat. No. 4,328,907 to Beard teaches still another dispenser for moistened paper tissues. The dispenser taught by Beard includes an inverted frusto-conical dispensing nozzle with a central orifice in the base thereof. A sealing closure is provided which engages the frusto-conical dispensing nozzle. The sealing closure is connected by an integral flap to the main body of the lid of the container.

U.S. Pat. No. 4,651,895 to Niske, et al. teaches a sealable dispenser for individual moistened towelettes. The dispenser included a dispensing nozzle having a orifice therethrough. A plurality of shapes for the dispensing orifice are taught (see FIGS. 2 through 8 of Niske, et al.).

Nothing in the prior art teaches a wet wipe dispensing nozzle which reacts to the direction from which the wet wipe is pulled to alleviate some of the frictional force imparted to the wet wipe as it exits the dispenser. Further, nothing in the prior art teaches a wet wipe dispensing nozzle which reacts to the twisting of the lead end of the web remaining in the dispenser after a sheet has been dispensed such that some of the twisting is alleviated.

SUMMARY OF THE INVENTION

It is therefore an object of the present invention to provide a wet wipe dispensing nozzle which reacts to the direction from which the wet wiper is drawn therethrough to alleviate some of the frictional force exerted on the wet wipe as it passes through the dispensing orifice.

Another object of the present invention is to provide a wet wipe dispensing nozzle which includes a rotatable disk having a slotted dispensing opening therethrough.

A further object of the present invention is to provide a wet wipe dispensing nozzle with a rotatable dispensing disk wherein a plurality of dispensing slots intersect at a dispensing slot node.

Still another object of the present invention is to provide a wet wipe dispenser wherein liquid squeezed from the wiper as it is pulled through the exit orifice is permitted to flow back into the container.

Briefly stated, the foregoing and numerous other features, objects and advantages of the present invention will become readily apparent upon a reading of the detailed description, claims and drawings set forth hereinafter. These features, objects and advantages are accomplished by mounting to the lid of a wet wipe container a dispensing nozzle which includes a funneled portion having an orifice in the base thereof. A dispensing disk is rotatably supported immediately below the orifice, the dispensing disk having a plurality of slots therein converging at a node to form one contiguous dispensing opening.

The rotatable dispensing disk may also be provided with one or more drain holes therethrough which are separate from the dispensing opening. A nozzle cap is provided which sealingly engages the dispensing nozzle thereby creating a chamber in which the lead end of the web being dispensed is retained and enclosed for next dispensing. In such manner, with the lead end of the rolled web maintained in a sealed environment until it is ready to be dispensed, the amount of vapor allowed to transmit to the atmosphere is minimized. Any liquid which is squeezed off of the web as it is pulled through the dispensing opening falls to the bottom of the funneled portion collecting on the dispensing disk where it will fall through the drain holes and back into the container. Because the disk is rotatable, it will rotate to the position of least resistance depending on the direction from which the user pulls the web.

DETAILED DESCRIPTION OF THE PREFERRED EMBODIMENT

Figure 1:
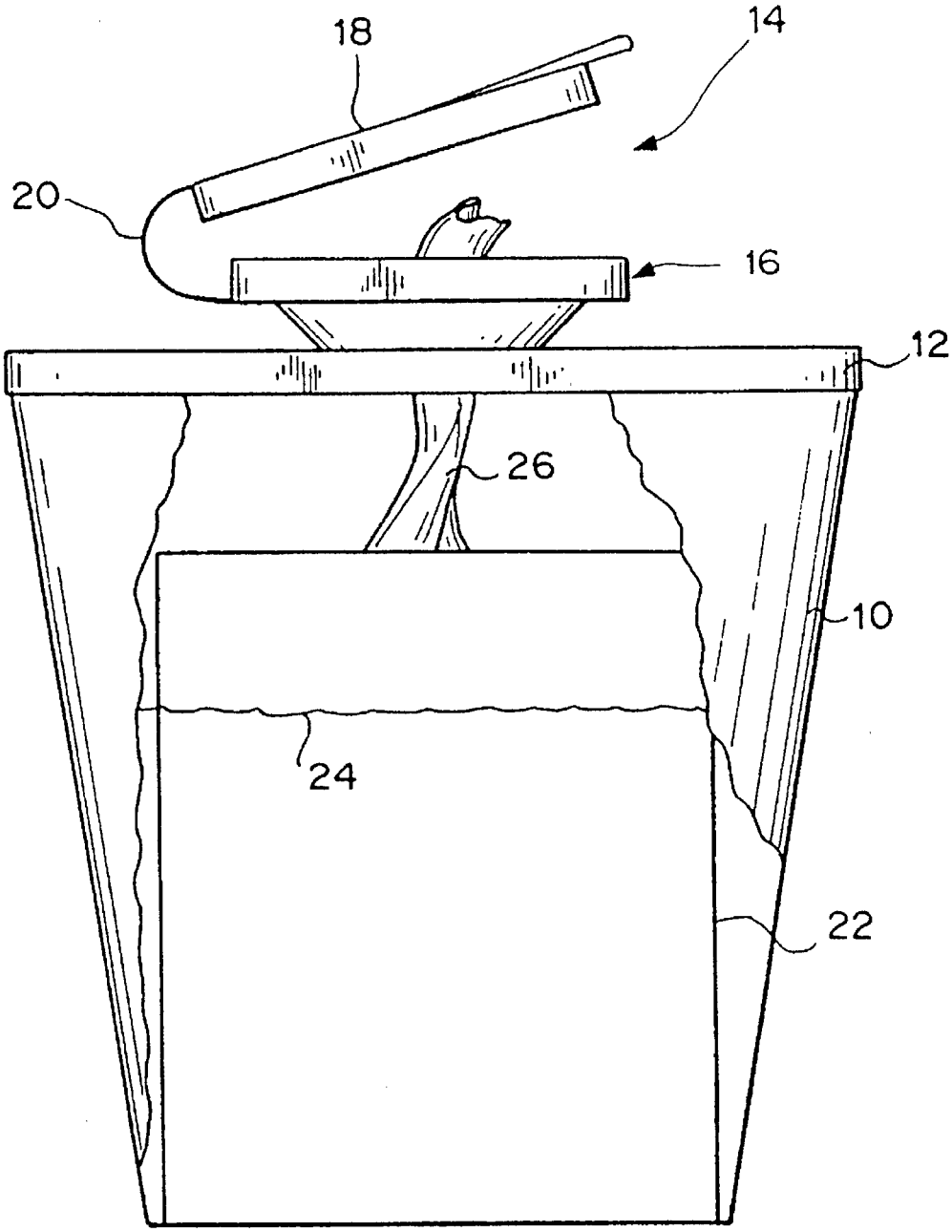
FIG. 1 is a side elevation of the improved wet wipe dispensing nozzle of the present invention mounted on a container for holding wet wipes.

Turning first to FIG. 1, there is shown a container 10 having a lid 12 mounted thereon. Lid 12 may be affixed to container 10 by means of threads, snap fitting, inter-engaging ribs, frictional engagement or the like. Attached to lid 12 is dispensing gateway 14. Dispensing gateway 14 includes dispensing nozzle 16, cap 18 and restraining strap 20. It is preferable that dispensing nozzle 16, cap 18 and restraining strap 20 are all integrally formed as a single piece. The preferred materials of construction are high density polyethelyne.

Disposed within container 10 is a coreless roll of wet wipes 22. Container 10 also holds a liquid such as a solvent up to a level 24 with which the roll 22 becomes saturated. The lead end 26 of roll 22 dispenses from the center of roll 22 up through the dispensing nozzle 16.

Figure 2:
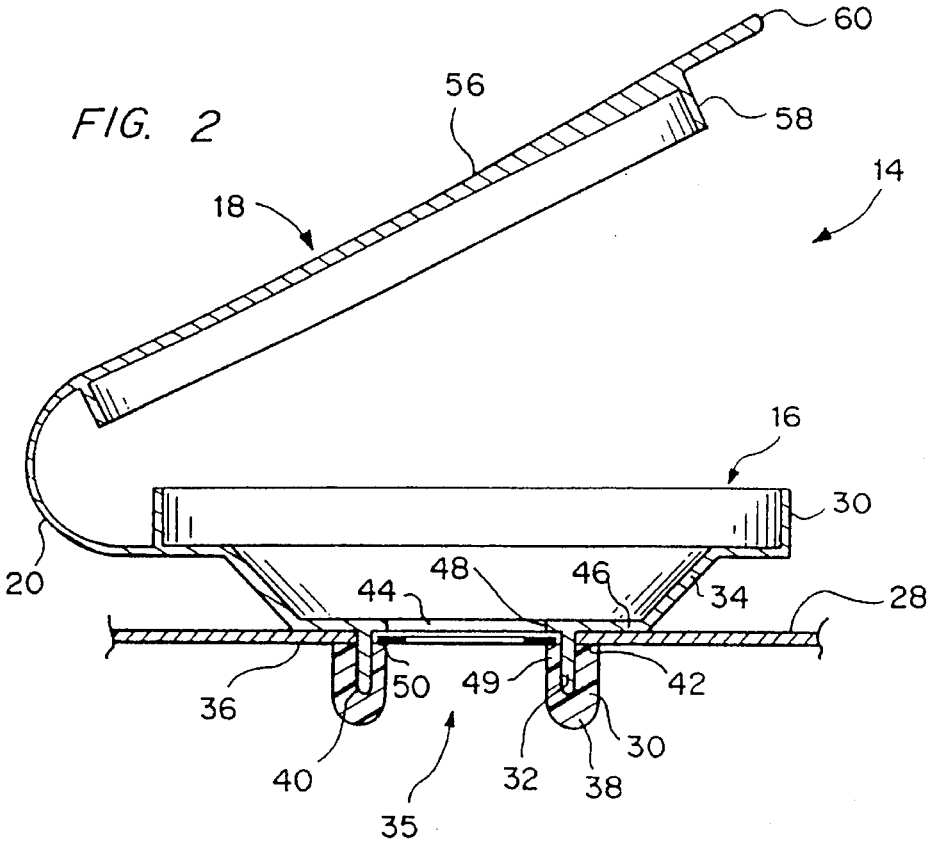
FIG. 2 is a cross sectional view of the improved wet wipe dispensing nozzle of the present invention.

Looking next at FIG. 2, there is shown a cross-sectional view of the dispensing gateway 14 of the present invention as mounted on the top planer surface 28 of lid 12. As shown therein, dispensing nozzle 16 includes an upper cylindrical wall 30, a lower cylindrical wall 32 and an intermediate funneled or frusto-conical section 34. The lower surface 28 of the frusto-conical section 34 is supported on the top surface 28 of lid 12 and is preferably sealingly engaged therewith to prevent liquid leaking therethrough should container 10 be knocked over and minimize vapor escaping therethrough to the atmosphere. Throat 32 extends through an opening 35 in top surface 28 of lid 12.

Dispensing nozzle 16 is affixed to lid 12 by means of retaining ring 38 which includes an annular slot 40 therein. Retaining ring 38 is press fit such that lower cylindrical wall or throat 32 is inserted into annular slot 40 thereby trapping lid 12 between lower surface 36 of frusto-conical section 34 and bearing surface 42 of retaining ring 38. Glue, silicone or the like may be used to aid the affixation of retaining ring 38 to throat 32 as well as between lower surface 36 and lid 12 and bearing surface 42 and lid 12.

There in an orifice or bore 44 through the base 46 of frusto-conical section 34. The base of frusto-conical section 34 extends radially inward past lower cylindrical wall or throat 32 to thereby create annular projection 48. An annular shelf 50 is provided by the top of the inner wall 49 of retaining ring 38. Residing between annular shelf 50 and annular projection 48 is rotatable dispensing disk 52 having dispensing orifice 54 therethrough. In such manner, annular shelf 50 serves as a retaining means for retaining dispensing disk 52 immediately below orifice 44 with throat 32 and annular projection 48 serving as a housing for dispensing disk 52. Because dispensing disk 52 is not as thick as the gap between annular projection 48 and annular shelf 50, dispensing disk 52 is allowed to freely rotate within throat 32 between the retaining means in response to external force.

Alternative retaining means can be used in place of retaining ring 38 and annular shelf 50 without departing from the scope of the present invention. Such alternative retaining means include pin-like projections extending radially inward and outward from lower cylindrical wall 32 allowing for nozzle 16 to be press-fit onto lid 12 and disk 52 to be press-fit into the housing. Similarly, press fitting could be accomplished with annular ribs.

As also can be seen from FIG. 2, cap 18 includes a top wall 56, and a cylindrical wall 58. Extending from top wall 56 on the side of cap 18 opposite restraining strap 20 is lift tab 60. A portion of top wall 56 may be thickened in the area adjacent lift tab 60 in order to add additional strength and prevent undue flexing when lift tab 60 is used to pry cap 18 off of nozzle 16. Cap 18 may be press fit onto dispensing nozzle 16 such that cylindrical wall 58 frictionally and sealingly engages upper cylindrical wall 30 thereby eliminating vapor emissions from container 10 when cap 18 is in the closed position.

Figure 3:
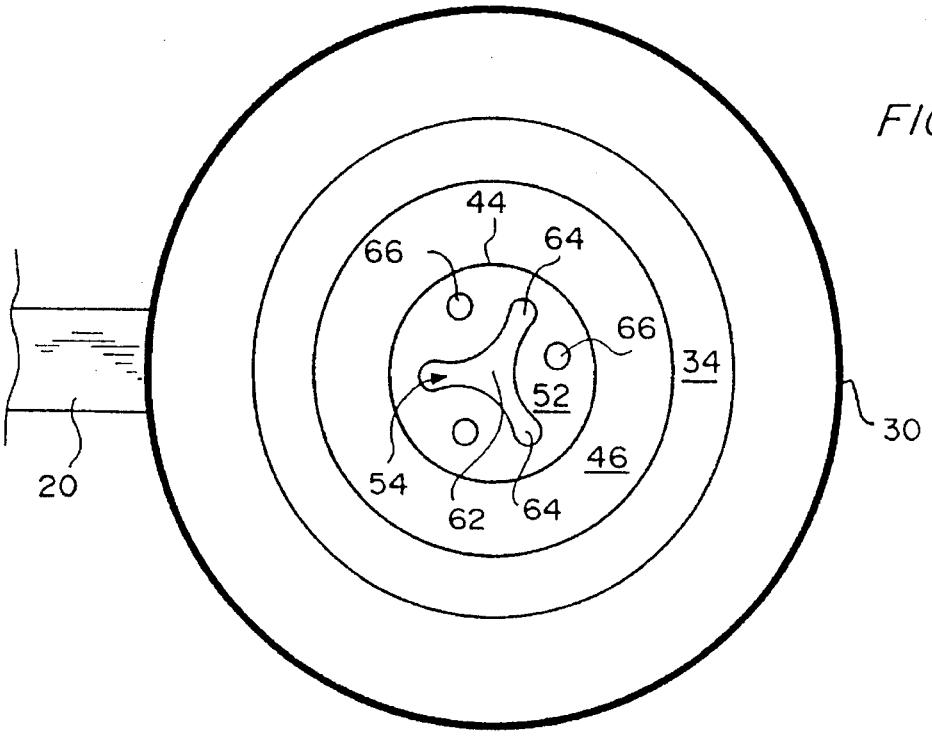
FIG. 3 is a top plan view of the improved wet wipe dispensing nozzle of the present invention.

Looking next at FIG. 3, it can be seen that dispensing orifice 54 through dispensing disk 52 includes a node 62 having a plurality of appendages 64 extending therefrom. Node 62 and appendages 64 are all contiguous with one another to form a single dispensing orifice 54. Three appendages 64 are preferred but the number of appendages 64 can be two (2) or greater depending on the size of disk 52 and the product being dispensed. The distal ends of each appendage 64 are preferably somewhat broadened as compared to the width of appendages 64. Dispensing disk 52 may also include one or more drain holes 66 therethrough which are not contiguous with dispensing orifice 54.

In operation, it is believed that the rotatable dispensing disk 52 allows for the substantial equalization of frictional forces on lead end 26 as it is drawn through dispensing orifice 54 regardless of the side of the container from which the user is pulling on lead end 26. The appendages 64 of dispensing orifice 54 creates a moment-arm effect as the lead end 26 is drawn therethrough causing the dispensing disk 52 to rotate to the path of least resistance. Thus, the user may be standing at any position in a 360° circle surrounding the container 10 and pull at lead end 26 to thereby withdraw the wet wiper from the dispenser and the frictional force should be substantially the same assuming that the angle to the vertical at which the lead end is pulled remains substantially the same. In such manner, the roll of wet wipes 22 should suffer fewer premature breaks during dispensing.

As the lead end 26 of the web is drawn through the dispensing orifice 54, it is likely that some of the liquid of the saturated wiper will be squeezed off as it is drawn through the restriction. The liquid should be collected within dispensing nozzle 16 with frusto-conical section 34 causing it to flow back toward orifice 40. As such free liquid encounters dispensing disk 52, it will be allowed to fall back within container 10 through drain holes 66.

It should be appreciated that dispensing from any center-flow dispenser will cause some twisting of the web as it uncoils from the center of the roll and is drawn through the dispensing orifice. It has been seen that the rotatable dispensing disk 52 relieves some of this twisting as each sheet is dispensed. As a sheet is dispensed and torn from the roll 22, dispensing disk 52 reacts to the twisting of the web within container 10 below orifice 54 by rotating slightly to thereby alleviate some of that twisting.

From the foregoing, it will be seen that this invention is one well adapted to obtain all of the ends and objects hereinabove set forth together with other advantages which are apparent and which are inherent to the apparatus.

It will be understood that certain features and subcombinations are of utility and may be employed with reference to other features and combinations. This is contemplated by and is within the scope of the claims.

As many possible embodiments may be made of the invention without departing from the scope thereof, it is to be understood that all matter herein set fort or shown in the accompanying drawings is to be interpreted as illustrative and not in a limiting sense.

What is claimed is:

1. A dispenser for dispensing saturated wipers comprising:

(a) a container;

(b) a lid attachable to said container;

(c) an opening through said lid;

(d) a dispensing gateway affixed to said lid, said dispensing gateway including a rotatable dispensing disk having a dispensing orifice therethrough, said dispensing orifice being substantially overlapped by said opening.

2. A dispenser for dispensing saturated wipers as recited in claim 1 wherein:

said orifice includes a node with a plurality of appendages extending therefrom.

3. A dispenser for dispensing saturated wipers as recited in claim 1 wherein:

said rotatable dispensing disk has at least one drain hole therethrough, said drain hole being discontiguous with said orifice.

4. A dispenser for dispensing saturated wipers as recited in claim 1 further comprising:

a cap attachable to and detachable from said nozzle.

5. A dispenser for dispensing saturated wipers as recited in claim 4 further comprising:

a restraining strap extending from said nozzle to said cap.

6. A dispensing gateway for dispensing saturated wipers from a container, said dispensing gateway comprising:

(a) a nozzle;

(b) means for affixing said nozzle to the container;

(c) a bore through said nozzle;

(d) a rotatable dispensing disk residing adjacent said bore.

7. A dispensing gateway through which saturated wipers can be dispensed from a container, said dispensing gateway comprising:

(a) a dispensing nozzle;

(b) means for affixing said dispensing nozzle to the container;

(c) a housing extending from said dispensing nozzle;

(d) a dispensing disk rotatably residing within said housing, said dispensing disk having an orifice therethrough.

8. A dispensing gateway through which saturated wipers can be dispensed from a container as recited in claim 7 wherein:

said orifice includes a node with a plurality of appendages extending therefrom.

9. A dispensing gateway through which saturated wipers can be dispensed from a container as recited in claim 7 wherein:

said rotatable dispensing disk has at least one drain hole therethrough, said drain hole being discontiguous with said orifice.

10. A dispensing gateway through which saturated wipers can be dispensed from a container as recited in claim 7, further comprising:

a cap attachable to and detachable from said nozzle.

11. A dispensing gateway which saturated wipers can be dispensed from a container as recited in claim 10, further comprising:

a restraining strap extending from said nozzle to said cap.

12. A dispensing gateway through which saturated wipers can be dispensed from a container as recited in claim 7 wherein:

said housing is substantially cylindrical and projects into the container.

13. A dispensing gateway through which saturated wipers can be dispensed from a container as recited in claim 7 further comprising:

means for retaining said dispensing disk adjacent said bore and within said housing.

14. A dispensing gateway through which saturated wipers can be dispensed from a container as recited in claim 13 wherein:

said retaining means engages said housing.

15. A dispensing gateway through which saturated wipers can be dispensed from a container as recited in claim 13 wherein:

said retaining means is a retaining ring having an annular slot therein which engages said housing, said retaining ring having an inner wall which provides a shelf for supporting said dispensing disk.

16. A dispenser for dispensing saturated wipers as recited in claim 7 wherein:

said housing is substantially cylindrical and projects into the container.

17. A dispenser for dispensing saturated wipers as recited in claim 7 wherein:

means for retaining said dispensing disk adjacent said bore and within said housing.

18. A dispenser for dispensing saturated wipers as recited in claim 17 wherein:

said retaining means engages said housing.

19. A dispenser for dispensing saturated wipers as recited in claim 17 wherein:

said retaining means is a retaining ring having an annular slot therein which engages said housing, said retaining ring having an inner wall which provides a shelf for supporting said dispensing disk.

20. A dispensing port through which a roll of wet wipes may be dispensed, said dispensing port comprising:

(a) housing;

(b) dispensing disk rotatably residing within said housing;

(c) shelf means located below said dispensing disk for supporting said dispensing disk within said housing;

(d) at least one projection located above said dispensing disk for retaining said dispensing disk within said housing;

(e) a dispensing orifice through said dispensing disk.

21. A dispensing port through which a roll of wet wipes is dispensed as recited in claim 20, wherein: said dispensing opening includes a node with a plurality of appendages extending therefrom.

22. A dispensing port through which a roll of wet wipes is dispensed as recited in claim 20, wherein: said dispensing disk has a least one drain hole therethrough, said drain hole being separate from said dispensing opening.

23. A dispensing port through which a roll of wet wipes is dispensed as recited in claim 20, wherein: there is a gap between said projection and said shelf means, said dispensing disk residing in said gap, said dispensing disk having a thickness which is less than said gap.

24. A dispensing port through which a roll of wet wipes is dispensed as recited in claim 20, wherein: said housing is a cylindrical wall means, said cylindrical wall mean having an inside diameter, and said disk means having an outside diameter, said outside diameter of said dispensing disk being less than said inside diameter of said cylindrical wall means.

* * * * *